United States Patent [19]

Collins, Jr.

[11] 4,421,183

[45] Dec. 20, 1983

[54] FLEXIBLE DRIVE APPARATUS FOR BORING LATERAL BORE HOLES FROM WELL

[76] Inventor: Earl R. Collins, Jr., 801 Craig Ave., La Canada, Calif. 91001

[21] Appl. No.: 249,895

[22] Filed: Apr. 1, 1981

[51] Int. Cl.[3] ..... E21B 3/04; E21B 17/20

[52] U.S. Cl. ..... 174/114; 74/841; 173/146; 166/50; 166/55.7; 175/61; 175/320

[58] Field of Search ..... 175/61, 79, 114; 173/146; 74/841

[56] References Cited

U.S. PATENT DOCUMENTS 1,865,853 7/1932 Granville ..... 175/79 X

FOREIGN PATENT DOCUMENTS 233512 4/1911 Fed. Rep. of Germany ..... 173/146
2232669 7/1975 France ..... 175/79
392 of 1872 United Kingdom ..... 173/146

*Primary Examiner*—Ernest R. Purser
*Attorney, Agent, or Firm*—Ellsworth R. Roston; Charles H. Schwartz

[57] ABSTRACT

Apparatus is provided for penetrating boreholes in oil wells. The apparatus includes a shaft rotatable by power means. First means may be operatively associated with the shaft and a rod to obtain a rotation of the rod by the shaft. Second means obtain a linear movement of the rod at each instant in accordance with a load imposed upon the rod at that instant. The second means may include means providing a slippage between the rotary movements of the shaft and the linear movements of the rod in accordance with the load on the rod. Third means are operatively coupled to the rod and are adaptable in configuration and position in accordance with the configuration of the bore hole to be penetrated. The third means may include an outer casing, a flexible boom movable within the outer casing and resilient means disposed within the flexible boom and movable within the outer casing. Means may rotate the resilient means in accordance with the rotation of the rod. Means may move the flexible boom linearly in accordance with the linear movement of the rod. Fourth means may be coupled to the flexible boom and the resilient means for operation in accordance with the linear movements of the flexible boom and the rotary movements of the resilient means. The fourth means penetrate the bore hole.

25 Claims, 6 Drawing Figures

FLEXIBLE DRIVE APPARATUS FOR BORING LATERAL BORE HOLES FROM WELL

This invention relates to apparatus for producing penetrations in the sidewalls of boreholes in oil wells for augmenting oil flow. The invention further relates to apparatus for producing a number of such penetrations simultaneously. The invention is particularly concerned with producing "clean" holes which are sharply defined and which do not have any contamination creating subsequent difficulties.

In recovering oil from some existing wells, the sidewall casing is perforated horizontally to promote drainage from the surrounding strata. Such perforations are usually provided by explosive cartridges or jets. The cartridges are armor-piercing bullets which penetrate the steel wall of the casing and also penetrate the cement which holds the casing in position in the bored hole. The jet is a shaped explosive charge which also penetrates the sidewall somewhat more extensively than the cartridge but shatters the surrounding rock for a distance of approximately only six (6) to eight (8) inches.

Neither the cartridge nor the jet has been found to be satisfactory. For example, the cartridges penetrate beyond the sidewall into the strata for only a relatively short distance. This distance has been found insufficient to produce an optimal flow of fluid from the surrounding strata into the borehole. For example, a penetration in the order of fifteen inches (15") beyond the sidewall of the borehole has been found to be desirable.

The jet tends to glaze or seal the resultant penetration. This causes the stratum to become sealed against a flow of oil into the borehole at the same time that the stratum is being penetrated. Furthermore, the jet also tends to penetrate the stratum around the borehole for an insufficient distance.

Since the cartridges and jets have penetrated for an insufficient distance the stratum surrounding the borehole, additional drilling has had to be performed to obtain the penetration of the stratum through a desired distance. In providing such additional penetration, drilling mud has had to be used. Such drilling mud has tended to create an impervious layer which has prevented oil from passing through the surrounding stratum into the borehole.

A considerable effort has been made to provide apparatus which penetrates the surrounding strata of boreholes without the disadvantages discussed above. Such efforts have been especially pronounced in recent years in view of the significant rise in the price of oil and in view of the resultant efforts to obtain secondary and even tertiary recovery of oil from strata surrounding boreholes in oil wells. In spite of such efforts, the problems discussed above still exist.

This invention provides apparatus which overcomes the above difficulties. The invention provides for a penetration of steel casings and the cement supporting structure to depths of fifteen (15) inches or more. The apparatus provides penetrations which are sharply defined. The apparatus produces such penetrations without the use of any charges or jets.

The penetration provided by the apparatus of this invention is "clean" in the sense that contaminations resulting in the production of impervious layers in the surrounding strata are avoided. For example, no drilling mud has to be used in the apparatus constituting this invention. The apparatus is further advantageous in that it can use petroleum fluid from the surrounding strata as the drilling fluid. The use of petroleum fluid as the drilling fluid is advantageous not only because it is available from the surrounding strata but also because it provides good lubrication without producing a contamination of the strata.

The apparatus of this invention has other important advantages. For example, it is automatically adaptable to the characteristics of the surrounding stratum by penetrating the stratum at a rate inversely related to the resistance of the stratum. The apparatus can also penetrate the sidewall of the borehole concurrently at a number of different positions. Furthermore, each of such penetrations can occur on a controlled basis independently of the penetration of the other holes.

The apparatus of this invention includes a shaft rotatable by power means. First means may be operatively associated with the shaft and a rod to obtain a rotation of the rod by the power means. The first means may include gears on the shaft and the rod in mesh with each other.

Second means obtain a linear movement of the rod at each instant in accordance with a load imposed upon the rod at that instant. The second means may include means providing a slippage between the rotary movement of the shaft and the linear movements of the rod at each instant in accordance with the load on the rod at that instant.

Third means are operatively coupled to the rod and are adaptable in configuration and in position in accordance with the configuration of the borehole to be penetrated. The third means may include an outer casing, a flexible boom movable with the outer casing and resilient means disposed within the flexible boom and movable within the outer casing. Means may be included for rotating the resilient means in accordance with the rotation of the rod. Means may also be included for moving the flexible boom linearly in accordance with the linear movement of the rod.

Fourth means are operatively coupled to the adaptable means to provide a penetration of the borehole. The fourth means may be coupled to the flexible boom and the resilient means for operation in accordance with the linear movements of the flexible boom and the rotary movements of the resilient means.

Figure 3:
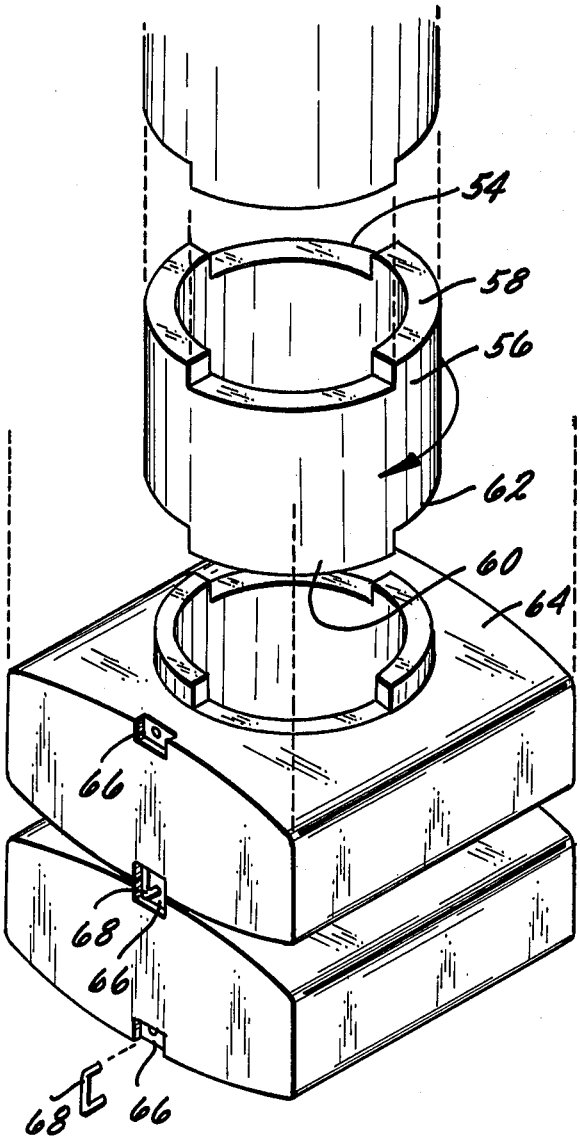
FIG. 3 is an enlarged fragmentary exploded perspective view of certain members in the apparatus shown in FIG. 2 for producing a transfer of rotary motion on a flexibly coupled basis.
Figure 4:
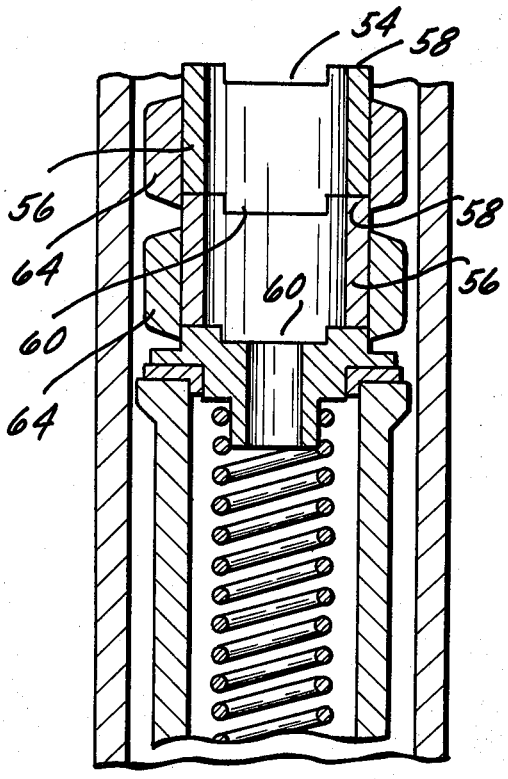
FIG. 4 is an enlarged fragmentary sectional view of the apparatus shown in FIG. 3 and of other apparatus for transferring linear motion on a flexibly coupled basis.
Figure 5:
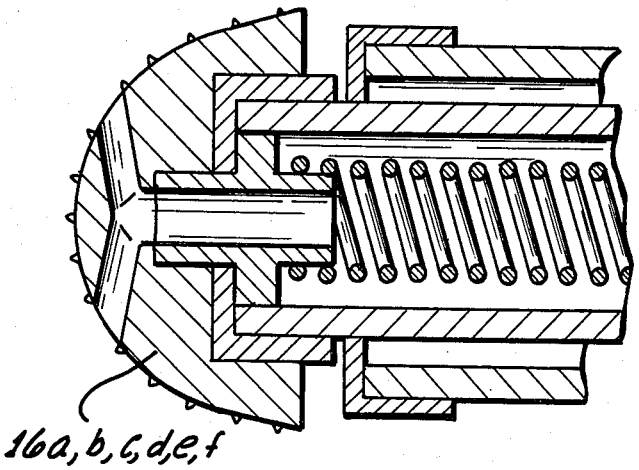
Figure 6:
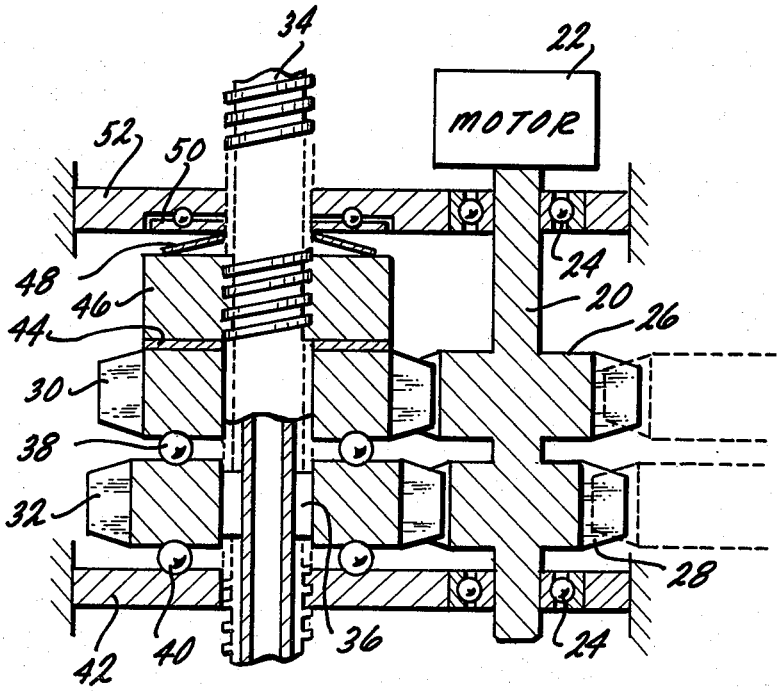

FIG. 5 is an enlarged fragmentary sectional view in elevation of apparatus shown in FIGS. 3 and 4 and of a drill bit at the end of such apparatus for obtaining a transfer of linear and rotary motions to the drill bit; and FIG. 6 is an enlarged fragmentary view in elevation of apparatus for producing a rotary motion of the drill rod and for producing a linear movement of the drill rod at each instant in accordance with the load imposed upon the rod by the drill bit at that instant.

In the embodiment of the invention shown in the drawings, a casing generally indicated at 10 and made from a suitable material such as steel is provided. The casing 10 is adapted to be disposed in a borehole 12 of an oil well. Cement 14 is adapted to be disposed around the outer periphery of the casing 10.

Figure 2:
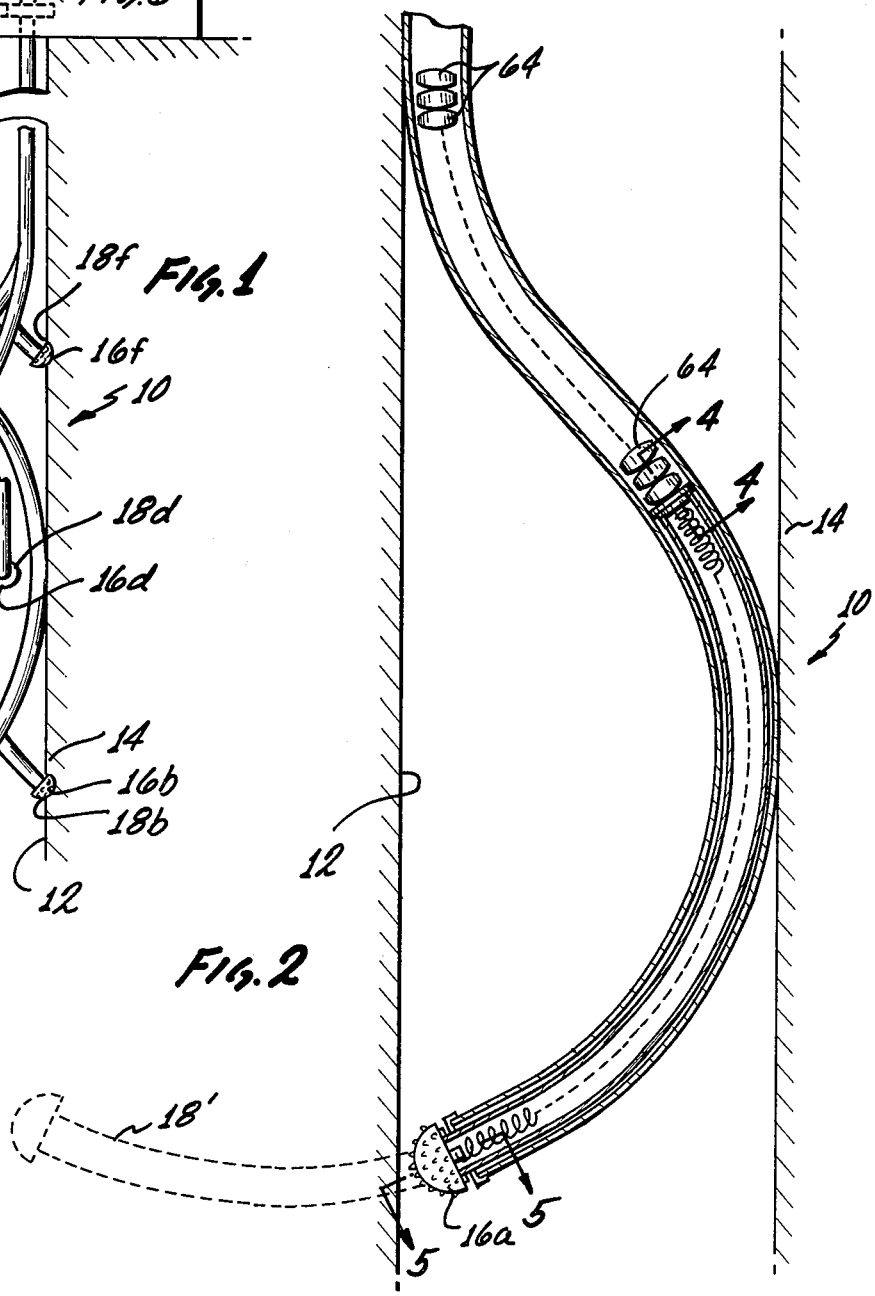
FIG. 2 is an enlarged schematic view of a particular portion of the apparatus in FIG. 1 for penetrating the sidewall in the borehole at one position.

A plurality of drill bits such as those illustrated at 16*a*, 16*b*, 16*c*, 16*d*, 16*e* and 16*f* are adapted to be disposed in the casing 10 to produce perforations such as those illustrated at 18*a*, 18*b*, 18*c*, 18*d*, 18*e* and 18*f*. The perforations 18*a* through 18*f* extend through the casing 10 and through the cement 14 and penetrate a particular distance such as approximately fifteen inches (15"), into the stratum surrounding the casing 10. This is illustrated by broken lines 18' for the drill bit 16*a* in FIG. 2.

Each of the drill bits 16*a* through 16*f* is rotated and moved linearly on a controlled basis to penetrate the casing. The rotation and linear movement may be obtained from the apparatus shown in FIG. 6. Such apparatus includes a shaft 20 driven by motor 22 and rotatable in bearings 24. A pair of gears 26 and 28 are mounted on the shaft 20 or are integral with the shaft. The gear 26 may have a greater diameter than the gear 28.

Gears 30 and 32 are mounted on a rod 34 and are respectively in mesh with the gears 26 and 28. The gear 30 may be slidably disposed on the rod 34 and the gear 32 may be splined to the shaft as at 36. The gears 30 and 32 may be separated as by rollers 38 so as to be rotatable relative to each other. Rollers 40 may also be provided between the gear 32 and a support plate 42 through which the rod 34 extends and which receives one of the bearings 24.

One face of a clutch 44 is disposed against the upper surface of the gear 30. The other face of the clutch is disposed against the lower surface of a nut 46. The nut 46 is provided with internal teeth which mesh with teeth externally disposed on the rod 34. A spring 48 is disposed between the nut 46 and a thrust bearing 50. The thrust bearing 50 is positioned by a support member 52, which also positions one of the bearings 24.

When the motor 22 is operated, it drives the gears 26 and 28. The gear 28 in turn drives the gear 32. Since the gear 32 is splined to the rod 34, the rod rotates and drives the drill bit 16*a* in a manner which will be described in detail subsequently.

The rotation of the gear 26 produces a corresponding rotation of the gear 30. When the load on the drill bit 18 is relatively low, the gear 30 drives the gear 46 without any slippage of the clutch 44. This causes the rod 34 to move linearly at a rate directly related to the rate at which the gear 26 is being rotated by the motor 22.

When the load imposed upon the rod 34 by the drill bit 18*a* is relatively large, the nut 46 slips on the clutch 44 relative to the gear 30. This causes the rod 34 to move linearly at each instant at a rate dependent upon the load imposed on the rod by the drill bit 16*a*. As will be appreciated, the load imposed by the drill bit 16*a* upon the rod 34 varies as penetration of the drill bit is made through the steel casing 10, the cement 14 and strata 50 surrounding the cement.

The rod 34 mates with detents 54 on the top one of a plurality of rotary sleeves 56. Each of the sleeves 56 is provided at its top end with lugs 58 annularly spaced to define the detents 54 and with lugs 60 annularly spaced to define detents 62. The lugs 60 are preferably displaced by an angle of 90° from the lugs 58. In this way, an interlocking relationship is produced between the lugs on each sleeve and the detents on the adjacent sleeves to drive the sleeves in accordance with the rotation of the rod 34.

The sleeves 56 are disposed within support segments 64 which are provided with cutouts 66 to receive clips 68. The segments 64 are movable linearly in a vertical direction in accordance with the linear movement of the rod 34. The clips 68 are particularly effective to retain the support segments 64 in assembled relationshp when retraction is provided of the assembly constituting this invention after the drilling operation has been completed.

The bottom one of the sleeves 56 is attached to an adapter 72. The adapter 72 is in turn attached to a flex-drive shaft 74 which may be in the form of a resilient spring. The adapter 72 is provided with a flange 76 which presses against a thrust bearing 78. The thrust bearing 78 is attached to an extendible boom 80 which is movable linearly and which envelops the flex-drive cable 74. The boom 80 is in turn disposed within a guide tube 82. The boom 80 and the guide tube 82 are made from a material having flexible characteristics.

As its bottom end, the flex-drive shaft 74 is attached to one end of an adapter 84, the other end of which is attached to a drill bit 88. The drill bit may be provided with fluid passageways 90 to facilitate the passage of fluid through the space within the boom 80 and the passageway 90 to the external surface of the drill bit. This provides for an optimal penetration of the strata surrounding the boreholes in the oil wells. For this purpose, the rod 34 may be made hollow to provide for the flow of fluid through the rod and the boom 80 to the drill bit 88.

A bushing 94 is disposed in contiguous relationship with the external surface of the boom 80 at the bottom end of the boom. The bushing 94 provides a bearing surface to facilitate rotation of the drill bit 88 relative to the boom 80. A bushing 96 is also disposed in contiguous relationship to the external surface of the guide tube 82 at the bottom end of the guide tube. The bushing 96 provides a bearing surface for a slidable movement of the boom 80 relative to the guide tube 82.

The guide tube 82 is disposed within the casing 10. When the drill bit 88 is to be operated, the rod 34 is rotated and moved linearly in a manner similar to that described above. The rotation of the rod 34 produces a rotation of the flex-drive shaft 74, which in turn produces a rotation of the drill bit 88. The linear movement of the rod 34 produces a linear movement of the guide boom 80 which in turn produces a linear movement of the drill bit 88. As previously described, the rate of linear movement of the drill bit 88 at each instant is dependent upon the load imposed upon the drill bit at that instant by the strata surrounding the drill bit.

The apparatus of this invention has certain important advantages. It provides a penetration of a borehole in an oil well without any explosive or jet charges. This provides for a clean, and not a contaminated, penetration of the borehole. The apparatus provides for a penetration of the borehole at an adjustable rate dependent upon the resistance offered by the strata surrounding the borehole. This prevents the drill bit from becoming jammed or the apparatus from becoming overloaded. In other words, the rate of penetration of the drill bit is dependent upon the resistance offered to the drill bit by the surrounding strata so that the drill bit cannot become locked into the strata and cannot become overheated.

Since the surrounding strata are clean even as the drill bit penetrates the strata, the penetration of the strata is not impeded. Furthermore, since the strata are clean, the petroleum fluid in the strata can be used as the drilling fluid to provide a lubricating surface on the strata for facilitating the penetration of the strata. The use of the petroleum fluid as the lubricating fluid is important because it is available from the surrounding strata and because it is natural to the site so that it cannot contaminate the strata.

Figure 1:
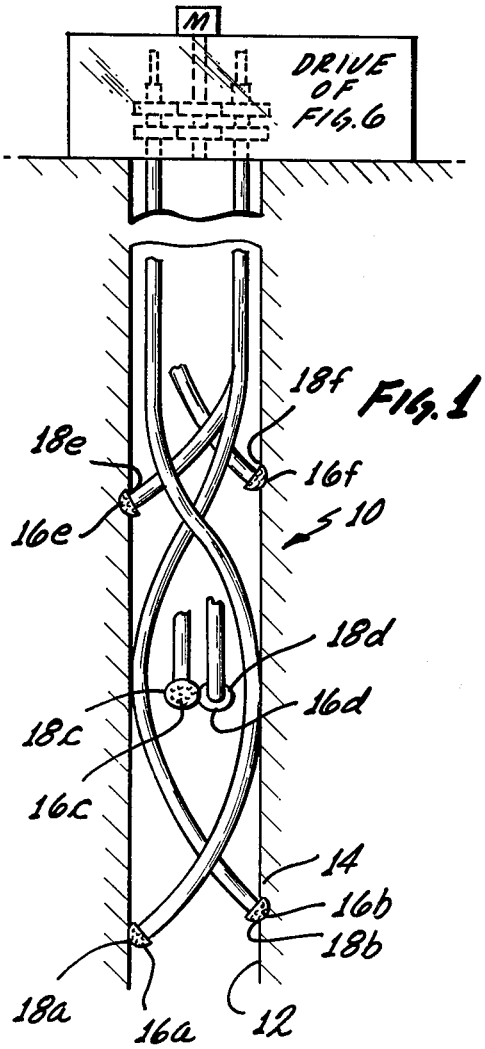
FIG. 1 is a fragmentary schematic elevational view of a borehole and apparatus in the borehole for concurrently penetrating the sidewall in the borehole at a number of spaced positions.

As will be appreciated, the drill bit 88 can penetrate the steel casing 10, the cement surrounding the steel casing and the earth formations extending outwardly from the cement. This penetration of the earth strata can occur to an optimum distance such as fifteetn (15) inches (15″). Furthermore, a number of penetrations can occur concurrently by providing a plurality of apparatuses each substantially identical to that described above. The concurrent operation of a plurality of apparatuses in penetrating boreholes at different positions in the borehole and in different directions through the steel casing 10 may be seen in FIG. 1.

Although this application has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. In combination for penetrating a borehole in an oil well, a rod movable in rotary and linear directions, means defining first and second gears at spaced positions on the rod, the rod having gear teeth on its external surface, a shaft, means defining third and fourth gears on the shaft in coupled relationship respectively with the first and second gears on the rod, a fifth gear on the rod in mesh with the gear teeth on the rod, clutch means operatively coupled on the rod to the second and fifth gears to provide slippage between the second and fifth gears in accordance with the load on the rod, and drilling means coupled to the rod for operation in accordance with the rotary and linear movements of the rod, the drilling means being provided with flexible characteristics for penetrating the borehole at adjustable positions in the borehole and for producing a load on the rod in accordance with the load imposed on the drilling means in the borehole.

2. The combination set forth in claim 1 wherein the fifth gear constitutes a nut disposed on the rod and rotatable relative to the rod to provide a linear movement of the rod in accordance with such rotary movement and the drilling means includes a flexi-drive shaft.

3. The combination set forth in claim 2 wherein the first gear is fixedly disposed on the rod for rotating the rod in accordance with the rotary movements of the first gear and is operatively coupled to the third gear on the shaft and means are provided for rotating the shaft and wherein the drilling means includes a resilient boom and the flexi-drive shaft is disposed within the resilient boom for resilient disposition of the boom and the flexi-shaft in the borehole.

4. The combination set forth in claim 3 wherein the first gear has a larger diameter than the second gear and the third gear has a smaller diameter than the fourth gear and the third and fourth gears are fixedly disposed on the shaft.

5. The combination set forth in claim 4 wherein the boom is disposed within a resilient tube and the drilling means include a drilling bit operatively coupled to the flexi-drive shaft.

6. In combination for penetrating a borehole in an oil well, a rod, first means operatively coupled to the rod for rotating the rod at a particular speed, second means operatively coupled to the rod for obtaining a linear movement of the rod at each instant in accordance with the load imposed upon the rod at that instant, third means including a flexi-drive shaft operatively coupled to the rod, the third means being flexibly adaptable in configuration and position in accordance with the configuration of the borehole to be penetrated, and fourth means operatively coupled to the third means to provide a penetration of the borehole at the adaptable position of the third means.

7. The combination set forth in claim 6, including, power means, a shaft rotatable by the power means, and the first means being operatively associated with the rod and the shaft to obtain a rotation of the rod by the power means, and the second means being operatively associated with the rod and the shaft to obtain a linear movement of the rod by the power means at each instant in accordance with the load imposed on the rod at that instant.

8. The combination set forth in claim 7, including, the second means including means providing a slippage between the rotary movements of the shaft and the linear movements of the rod in accordance with the load on the rod and the third means including a resilient boom and the flexi-drive shaft being disposed within the resilient boom.

9. The combination set forth in claim 8, including the fourth means being operatively coupled to the resilient boom, and the rod, the flexi-drive shaft, the boom and the fourth means being constructed to provide for a passage of fluid through the rod, the flexi-drive shaft, the boom and the fourth means to the borehole to lubricate the borehole.

10. The combination set forth in claim 9, including, the third means including a flexible guide tube and the flexible boom being disposed within the flexible guide tube and means associated with the boom and the guide tube for providing a slidable relationship between the boom and the guide tube.

11. The combination set forth in claim 8, including, the third means including a plurality of sleeve members disposed between the rod and the flexi-drive shaft and operatively coupled to the rod and the flexi-drive shaft for driving the flexi-drive shaft in accordance with the linear and rotary movements of the rod.

12. The combination set forth in claim 11, including, a plurality of sleeve members disposed in a linked relationship and operatively coupled to the rod at one end of the linked relationship and to the resilient means at the other end of the linked relationship for rotating the resilient means in accordance with the rotation of the rod, the sleeve members being adjustable in position relative to one another to define a resilient relationship.

13. The combination set forth in claim 6, including, the third means including:

an outer casing, a flexible boom movable within the outer casing, resilient means disposed within the flexible boom and movable with the boom within the casing, the fourth means being coupled to the flexible boom and the resilient means for operation in accordance with the operation of the flexible boom and the resilient means, means operatively coupled to the resilient means for rotating the resilient means in accordance with the rotation of the rod, and means operatively coupled to the flexible boom for moving the flexible boom axially in accordance with the linear movement of the rod.

14. In combination for penetrating an outer casing in a borehole in an oil well, a drilling bit, a boom flexible at substantially every position along its length and movable axially within the outer casing and constructed to be flexed into any desired configuration, means resilient at substantially every position along its length and rotatably disposed within the flexible boom and movable axially with the boom and constructed to be flexed into any desired configuration, first means operatively coupling the resilient means and the drilling bit for producing an axial movement of the drilling bit with the resilient means, second means operatively coupling the resilient means and the drilling bit for producing a rotary movement of the drilling bit with the resilient means, and third means operatively coupled to the first and second means for rotating the resilient means at a particular speed and for moving the resilient means axially at each instant at a rate variable in accordance with the load imposed upon the drilling bit at that instant in the borehole in the oil well.

15. The combination set forth in claim 14, including, the flexible boom, the resilient means, the drilling bit and the first, second and third means being constructed to provide for the flow of fluid to and through the drilling bit to lubricate the drilling bit.

16. The combination set forth in claim 14, including, the third means including a rod, the first means including first gear means operatively associated with the rod for rotating the rod at a particular speed, and the second means including second gear means operatively associated with the rod for obtaining an axial movement of the rod at a rate at each instant in accordance with the load imposed upon the drilling bit at that instant in the borehole in the oil well.

17. The combination set forth in claim 16, including, power means for driving the third means, and the second gear means including means providing a slippage between the operation of the power means and the axial movement of the rod at each instant in accordance with the load imposed upon the drilling bit at that instant in the borehole in the oil well.

18. The combination set forth in claim 14, including, the third means including, a rod, a shaft, drive means for rotating the shaft at a first particular speed, the first means including first gear means fixedly coupling the shaft to the rod for rotating the rod at a second particular speed related to the first particular speed, and the second means including second gear means coupling the shaft to the rod in a clutched relationship for moving the rod axially at each instant at a rate dependent upon the load imposed upon the drilling bit at that instant in the borehole in the oil well.

19. The combination set forth in claim 14, including, the second gear means including means disposed on the rod and providing a slippage between the operation of the drive means and the linear movement of the rod at each instant in accordance with the load imposed upon the drilling bit at that instant in the borehole in the well.

20. In combination for penetrating a borehole in an oil well, a rod, a shaft, means for driving the shaft, first means operatively coupled to the rod and the shaft for rotatably driving the rod in accordance with the operation of the drive means, a drill bit constructed to be disposed in the borehole, resilient means operatively coupled at one end to the drill bit and at the other end to the rod and flexible to any desired configuration in the borehole, second means including the drill bit and the resilient means and operatively coupled to the rod for providing for an imposition of a variable load on the rod in accordance with the load imposed on the drill bit in the borehole, and third means operatively coupled to the rod and the shaft for converting the drive of the shaft at each instant into a linear movement of the rod in accordance with the variable load imposed by the second means upon the rod.

21. The combination set forth in claim 20 wherein the second means includes a plurality of sleeve members disposed in a linked relationship and defining an adjustable configuration in the linked relationship and operatively coupled at one end to the rod and at the other end to the resilient means for driving the resilient means in accordance with the rotary and linear movements of the rod.

22. The combination set forth in claim 20 wherein a resilient boom receives the resilient means and is flexible in accordance with the flexure of the resilient means, and means are operatively coupled to the drill bit and the boom for providing a bearing surface between the drill bit and the boom.

23. The combination set forth in claim 20 wherein the first means includes first gear means fixedly disposed on the shaft and on the rod for rotatably driving the rod in accordance with the operation of the drive means, and the third means includes second gear means on the shaft and on the rod for rotatably driving the rod and further includes means disposed on the rod for converting such rotary motion to a linear motion of the rod and further includes clutch means disposed between the second gear means and the converting means for providing a slippage between the second gear means and the converting means in accordance with the load imposed in the borehole on the drill bit to obtain at each instant a linear movement of the rod in accordance with such load at that instant.

24. The combination set forth in claim 23, including, the rod and the second means being constructed to provide for the introduction of a drilling fluid to the drill bit to lubricate the drill bit.

25. The combination set forth in claim 23 wherein the rod is provided with gear teeth on its outer surface and the converting means includes a gear in mesh with the gear teeth on the rod and operatively coupled to the clutch means for rotating at a speed variable at each instant in accordance with the load imposed in the borehole on the drill bit at that instant.

* * * * *